US005430419A

United States Patent [19]

Scheel et al.

[11] Patent Number: 5,430,419

[45] Date of Patent: Jul. 4, 1995

[54] DOUBLE BREAK CIRCUIT BREAKER HAVING IMPROVED SECONDARY SECTION

[75] Inventors: Jerry L. Scheel; Randall L. Siebels, both of Cedar Rapids; Matthew D. Sortland, Swisher; John M. Winter; Dale W. Bennett, both of Cedar Rapids, all of Iowa

[73] Assignee: Square D, Palatine, Ill.

[21] Appl. No.: 181,522

[22] Filed: Jan. 13, 1994

[51] Int. Cl.[6] ..... H01H 75/00

[52] U.S. Cl. ..... 335/16; 335/147; 335/195

[58] Field of Search ..... 335/16, 147, 195; 200/147 R

[56] References Cited

U.S. PATENT DOCUMENTS

| | | | |
|---|---|---|---|
| 3,943,316 | 3/1976 | Oster . | |
| 3,943,472 | 3/1976 | Oster et al. . | |
| 3,944,953 | 3/1976 | Oster . | |
| 3,946,346 | 3/1976 | Oster et al. | 335/16 |
| 4,458,224 | 7/1984 | Kralik et al. | 335/16 |
| 4,740,768 | 4/1988 | Morris et al. . | |
| 5,003,139 | 3/1991 | Edds et al. . | |
| 5,075,657 | 12/1991 | Rezac et al. . | |
| 5,097,589 | 3/1992 | Rezac et al. . | |
| 5,159,304 | 10/1992 | Yamagata et al. . | |
| 5,245,302 | 9/1993 | Brune et al. . | |

*Primary Examiner*—Lincoln Donovan

*Attorney, Agent, or Firm*—Larry I. Golden; Kareem M. Irfan

[57] ABSTRACT

A circuit breaker includes a first section and a second section with substantially independently operating pairs of contact assemblies in each respective section. In the first section, at least one of the contact assemblies is constructed and arranged to interrupt the current by moving from a normally closed position to a blown-open position and latching with the contact assemblies separated. The second section has a biasing extension spring for biasing the contact assemblies of the second section so as to permit interruption of the current in response to a blow-open force, which causes the contacts to separate only momentarily and then return to a normally closed position. The first and second pairs of contact assemblies separate substantially simultaneously in response to the blow-open force, and only the first section reacts to lower-level over-current conditions. To prevent welding or sticking of the contacts in the second section, a kicker is interposed between the pairs of contact assemblies so as to slightly open the contact assemblies in the second section in response to the contact assemblies of the first section reacting to the lower-level over-current conditions. The circuit breaker is designed to operate using "Z-axis" mountable components.

31 Claims, 8 Drawing Sheets

DOUBLE BREAK CIRCUIT BREAKER HAVING IMPROVED SECONDARY SECTION

FIELD OF THE INVENTION

The present invention relates generally to circuit breakers and, more particularly, to circuit breakers having multiple sets of contacts for interrupting a single current path through the circuit breaker.

BACKGROUND OF THE INVENTION

Use of circuit breakers is widespread in modem-day residential, commercial and industrial electric systems, and they constitute an indispensable component of such systems toward providing protection against over-current conditions. Various circuit breaker mechanisms have evolved and have been perfected over time on the basis of application-specific factors such as current capacity, response time, and the type of reset (manual or remote) function desired of the breaker.

One type of circuit breaker mechanism employs a thermo-magnetic tripping device to "trip" a latch in response to a specific range of over-current conditions. The tripping action is caused by a significant deflection in a bi-metal or thermostat-metal element which responds to changes in temperature due to resistance heating caused by flow of the circuit's electric current through the element. The thermostat metal element is typically in the form of a blade and operates in conjunction with a latch so that blade deflection releases the latch after a time delay corresponding to a predetermined over-current threshold in order to "break" the current circuit associated therewith. Circuit breaker mechanisms of this type often include a mechanism operating upon a lever to release the breaker latch in the presence of a short circuit or very high current condition. A handle or push button mechanism is also provided for opening up the electric contacts to the requisite separation width and sufficiently fast to realize adequate current interruption.

Another type of circuit breaker, referred to as a "double-break" circuit breaker, includes two sets of current-breaking contacts to accommodate a higher level of over-current conditions than is accommodated by the one discussed above. One such double-break circuit breaker implements its two sets of contacts using the respective ends of an elongated rotatable blade as movable contacts which meet non-movable contacts disposed adjacent the non-movable contacts. The non-movable contacts are located on the ends of respective U-shaped stationary terminals, so that an electro-magnetic blow-off force ensues when the current, exceeding the threshold level, passes through the U-shaped terminals. Thus, when this high-level over-current condition is present, the blow-off force causes the elongated rotatable blade to rotate and the two sets of contacts to separate simultaneously.

Another type of double-break circuit breaker implements its two sets of contacts using separate and independent structures. For example, one set of contacts may be implemented using the previously-discussed thermo-magnetic tripping device to trip the current path at low-level current conditions, and the other set of contacts using an intricate and current-sensitive arrangement which separates its contacts in response to high-level blow-off current conditions. See, for example, U.S. Pat. Nos. 3,944,953, 3,96,346, 3,943,316 and 3,943,472, each of which is assigned to the instant assignee.

While providing adequate protection to high-level over-current conditions, such double-break circuit breakers are overly complex, and difficult to manufacture and service. With respect to their manufacture, for example, the complexity of the control mechanism for separating each set of contacts adds significantly to the overall component part count for the circuit breaker. Consequently, material and assembly costs for such circuit breakers are relatively high.

Double-break circuit breakers also have power-related disadvantages that are not found in the first-described (single-break) circuit breaker. These double-break circuit breakers typically develop contact resistances which create higher power losses. The power losses fluxuate from one operation to the next, thereby making the double-break circuit breaker unreliable and burdensome to maintain.

Accordingly, there is a need for a double-break circuit breaker that can be implemented without the aforementioned shortcomings.

SUMMARY OF THE INVENTION

The present invention provides a circuit breaker having a double-break current-path interrupting mechanism which overcomes the above-mentioned deficiencies of the prior art.

The present invention further provides a circuit breaker having a double-break current-path interrupting mechanism operating with lower peak currents, lower $I^2t$ energy, and high interruption ratings in a relatively small package.

In one implementation of the present invention, a circuit breaker includes a pair of primary contact assemblies, a spring and a pair of secondary contact assemblies. At least one of the primary contact assemblies interrupts the current by moving from a normally closed position to an open position and latches with the primary contact assemblies separated. One of the secondary contact assemblies is stationary and the other of the secondary contact assemblies has a movable contact arm rotatable about a pivot and biased by the spring toward a normally closed position such that, in response to an over-current condition exceeding a predetermined level, the movable contact arm rotates away from the normally closed position against the bias of the spring until the over-current condition fails below the predetermined level at which time the movable contact arm rotates toward the normally closed position.

According to another embodiment of the present invention, a circuit breaker includes a pair of primary contact assemblies, a pair of secondary contact assemblies, a spring, and an engagement member. At least one of the primary contact assemblies is constructed and arranged to interrupt the current by moving from a normally closed position to at least one open position, and at least one of the secondary contact assemblies is biased by the spring toward a normally closed position and is rotatable about a pivot away from the normally closed position against the bias of the spring. The engagement member, which is coupled to one of the primary contact assemblies and to one of the secondary contact assemblies, causes one of the secondary contact assemblies to rotate about the pivot in response to one of the primary contact assemblies moving from the normally closed position.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which.

Figure 1:
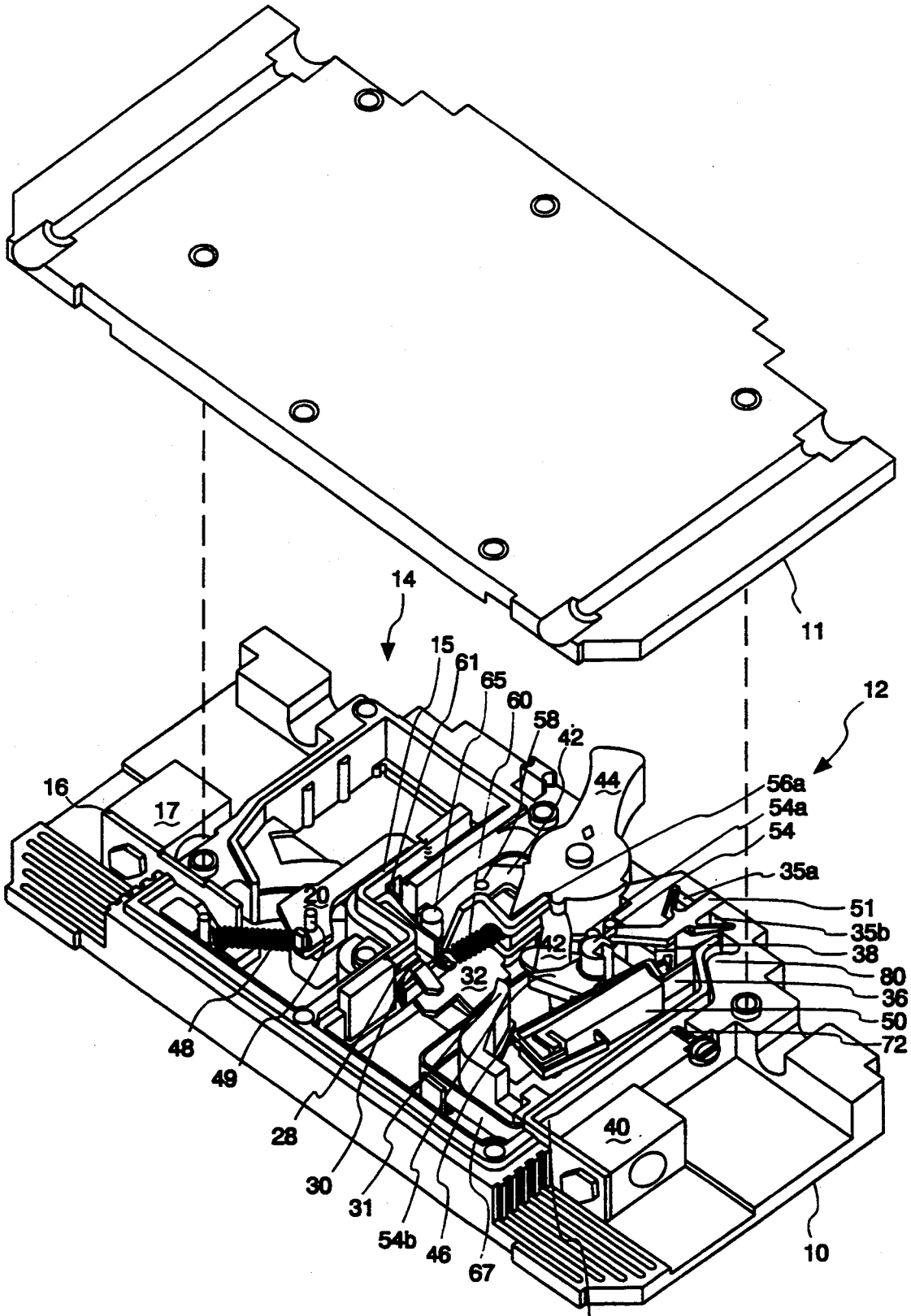
FIG. 1 is an illustration of a circuit breaker, in accordance with the present invention, with the circuit breaker cover removed so as to illustrate the components within the circuit breaker.

While the invention is susceptible to various modifications and alternative forms, specific embodiments thereof have been shown by way of example in the drawings and will be described in detail. It should be understood, however, that it is not intended to limit the invention to the particular form described. On the contrary, the intention is to cover all modifications, equivalents and alternatives falling within the spirit and scope of the invention as defined by the appended claims.

DETAILED DESCRIPTION OF THE FIGURES

While the present invention may be used in a wide variety of residential, commercial and industrial applications, the implementation of the present invention shown in FIG. 1 is ideally suited for applications requiring high performance, low cost, and design simplicity in a small package.

The circuit breaker of FIG. 1 includes an enclosure (including base 10 and cover 11) having numerous component compartments (in the form of molded protrusions) to retain the internal components of the circuit breaker, the majority of which reside in a primary section 12 or in a secondary section 14. While there is no definitive line of distinction between the primary and secondary sections, a conductive mid terminal 15 may be used to delineate generally the components in the primary section 12 (to the right of the mid terminal 15) and the components in the secondary section 14 (to the left of the mid terminal 15).

Figure 2:
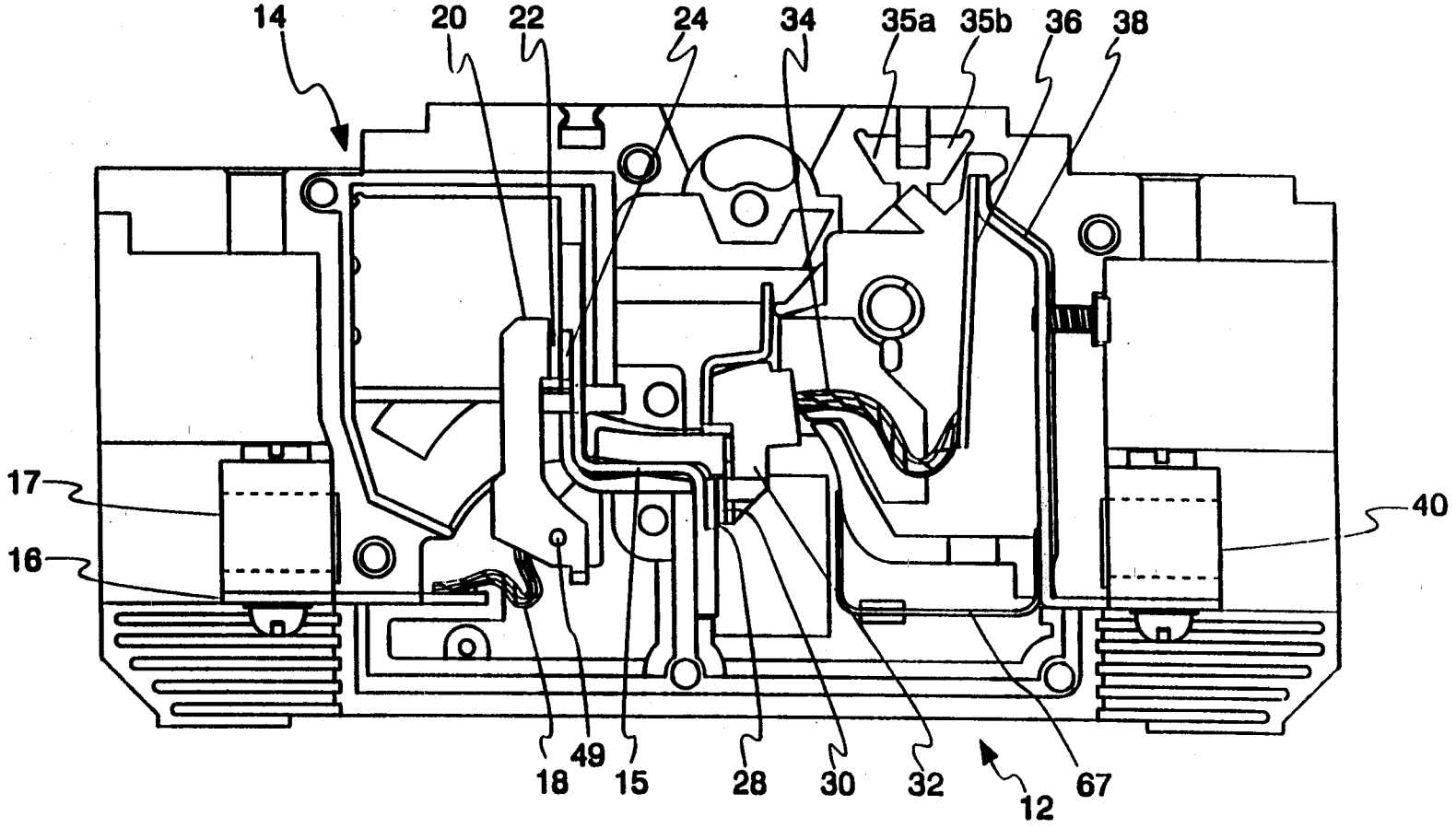
FIG. 2 is an illustration of the circuit breaker of FIG. 1 with certain components removed so as to illustrate the current path through the circuit breaker.

The current path through the circuit breaker is best viewed by referring to FIG. 2, which shows the circuit breaker of FIG. 1 with certain components removed for illustrative purposes. The current path begins within the secondary section 14 at a line terminal 16. The line terminal 16 includes a conventional line block (or lug) 17 for clamping the line wire within an aperture (not shown) therein. From the line terminal 16, a flexible conductor (or pigtail) 18 connects the current path to a rotatable secondary blade 20 which, along with a secondary blade contact 22 and a mating stationary contact 24, are used to establish a pair of contact assemblies for the secondary section 14.

From the stationary contact 24, current flows through the mid terminal 15 to a pair of contact assemblies for the primary section 12, including a stationary contact 28 and a mating rotatable primary blade contact 30. The stationary contact 28 is welded to the lower portion of the mid terminal 15, near its lower end. The mating contact 30 is welded to a primary blade 32, which rotates about blade pivot 33, 56*a* and 56*b* in response to a trip mechanism (illustrated and discussed in connection with FIG. 3). Current flows through the stationary and moveable contacts 28 and 30, through the primary blade 32, and into one end of a primary flexible connector (or pigtail) 34. The other end of the primary flexible connector 34 is attached to a bimetal member 36, which provides the thermal tripping characteristics for the circuit breaker. Finally, the current flows from the bimetal member 36 through a load terminal 38 and out of the load end of the circuit breaker via a terminal block (or lug) 40.

The mid terminal 15 is "S "-shaped and arranged with respect to the secondary and primary blades 20 and 32 to form a "U"-shape conductive path for each pair of contact assemblies. Such a "U"-shape construction is used to form a sufficiently strong electromagnetic blow-off force to separate each pair of contacts in response to an over-current condition of sufficient magnitude. For further information regarding the manufacture and operation of the mid terminal 15, reference may be made to U.S. patent application Ser. No. 08/181,277 entitled "Mid Terminal for a Double Break Circuit Breaker", filed Jan. 13, 1994 and assigned to the instant assignee (incorporated herein by reference).

Figure 3:
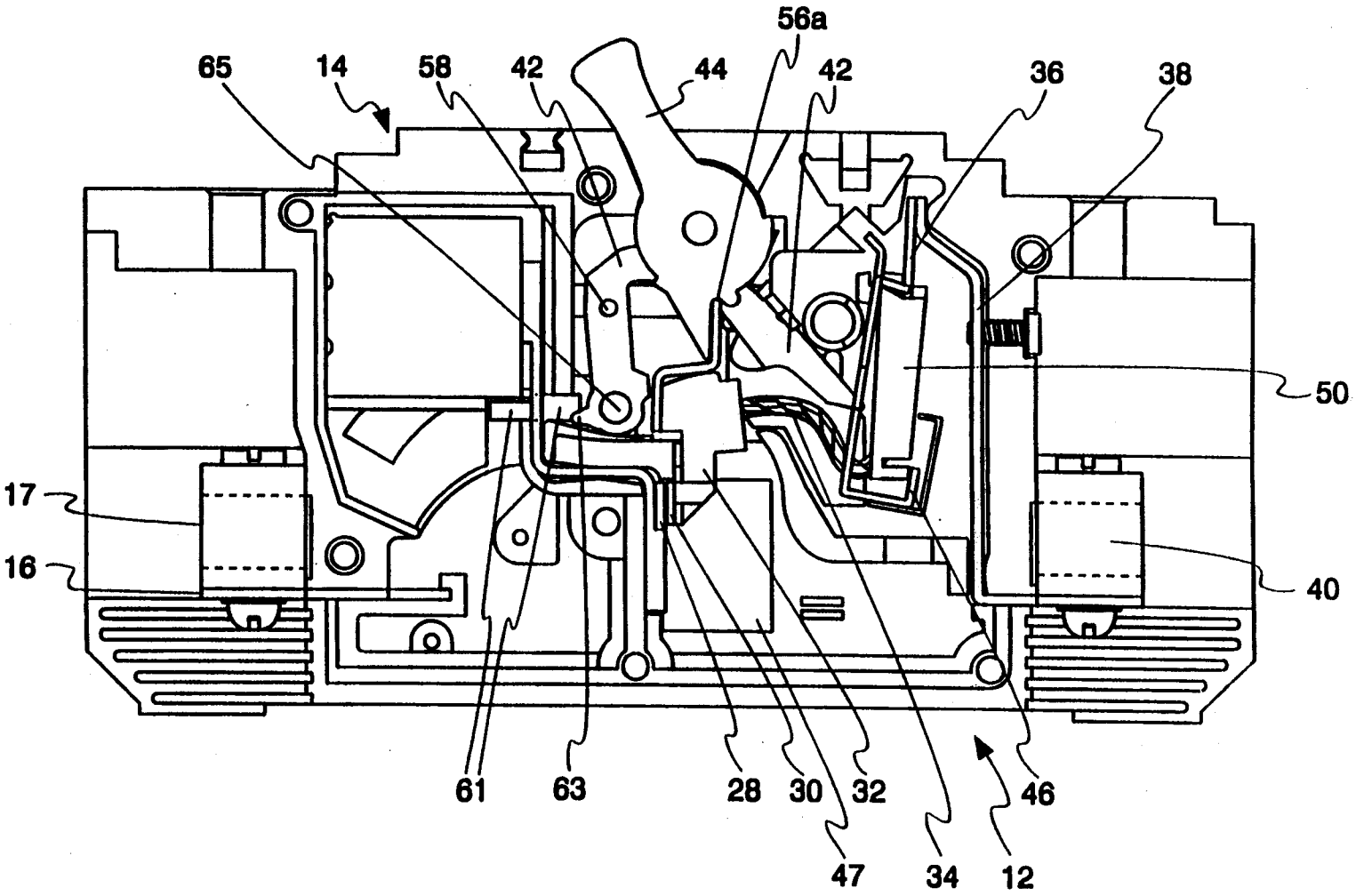
FIG. 3 is an illustration of the circuit breaker of FIG. 1 with certain components removed in order to illustrate the tripping mechanism.
Figure 4B:
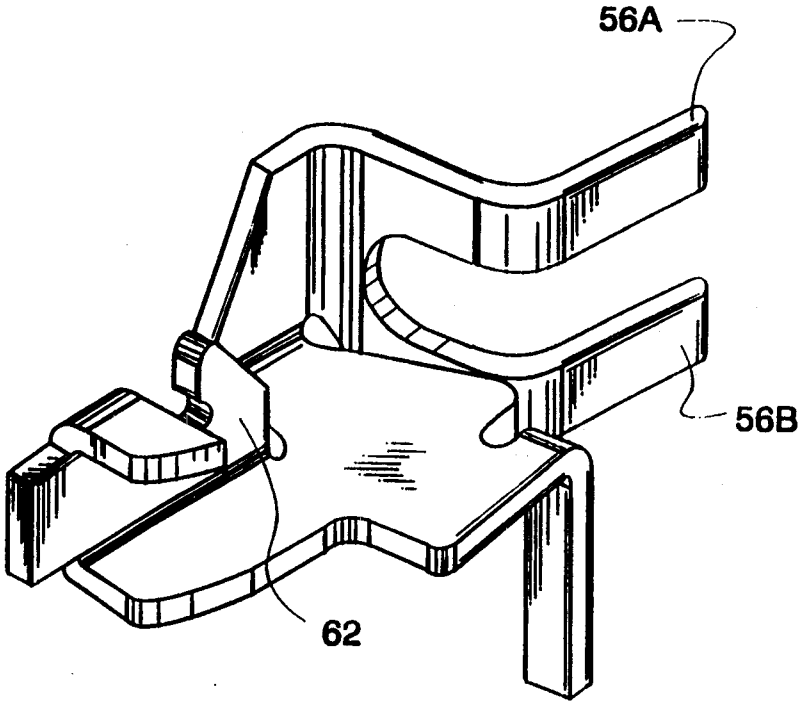
FIGS. 4*a* and 4*b* are perspective illustrations of the primary blade, according to the present invention, used in the circuit breaker of FIG. 1.
Figure 4A:
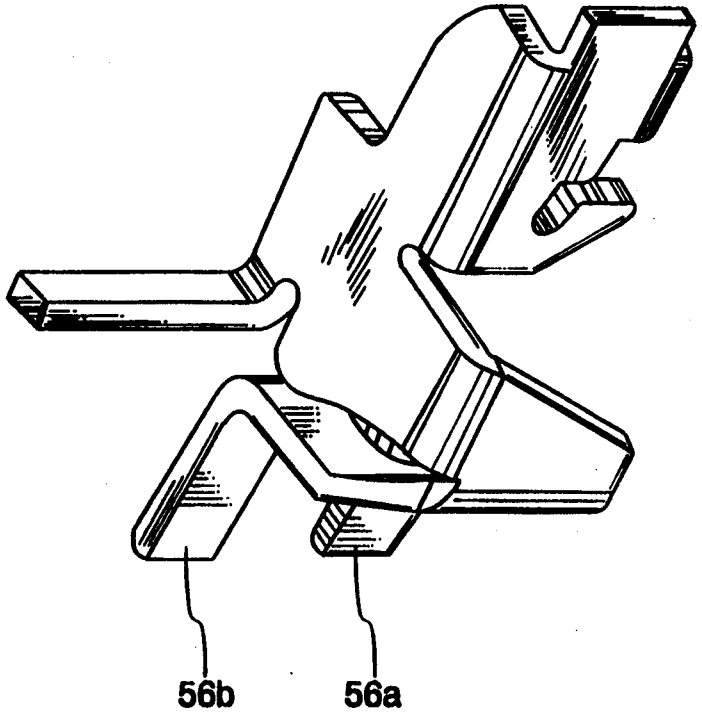

With reference to FIGS. 1 and 3, the primary section of the circuit breaker also includes a trip lever 42, a handle 44, a magnetic armature 46, a primary arc stack 47 and a yoke 50. These components are used to implement the manual ON/OFF operation, the thermal-trip separation, and the electro-magnetic trip separation of the primary contacts 28 and 30.

The manual ON and OFF operation of the primary blade 32 occurs in response to the manual rotation of the handle 44 in a clockwise or counterclockwise motion. In response to rotation of the handle 44 in either direction, the primary blade 32 either opens or closes the circuit via the primary moveable contact 30 and the primary stationary contact 28. Rotation of the primary blade 32 is coupled directly to the handle 44 at interface points 56*a* and 56*b* or the normal ON and OFF operation of the primary blade 32. The secondary section is not affected by the normal ON and OFF operation of the primary blade 32, and the secondary blade contact 22 and the secondary stationary contact 24 remain in the closed position.

The thermal-trip separation of the primary contacts 28 and 30 provides current-interruption capacity for all current-overload levels from zero amperes to approximately 3000 amperes without operational assistance from the secondary section; that is to say, without requiring the secondary section to interrupt with the primary section. The primary section is ready to be tripped when the handle 44 is manually rotated first to the right for latching the trip lever 42 by the magnetic armature 46 and then to the left to turn the circuit breaker "on" (closing the current path). In response to carrying a relatively high level of current, via the bimetal member 36, the magnetic armature 46 is drawn to the yoke 50 to disengage the trip lever 42, thereby causing the trip lever 42 to rotate in the clockwise direction and the primary blade 32 to rotate in the counterclockwise direction to the tripped position. This results in the primary blade contact 30 separating from the stationary contact 28 and interrupting the current flow. Related tripping arrangements are shown in U.S. Pat. Nos. 2,902,560, 3,098,136, 4,616,199, and 4,616,200, and U.S. patent application Ser. No. 07/878648, each of which is assigned to the instant assignee and incorporated herein by reference.

The primary contacts 28 and 30 can also be tripped manually, e.g., for testing purposes, by depressing (via an aperture in the top of the enclosure) the top of a plastic one-piece repressible member 51 (FIG. 1). The repressible member 51 includes flexible arms and which fit into triangularly-shaped compartments 35*a* and 35*b* (FIG. 2) and, via the walls of these compartments 35*a* and 35*b*, provide resiliency to return the member 51 to its normal position after being depressed. The depressible member 51 is depressed to engage one wing 54*a* of a cam 54 (FIG. 1) which, in turn, rotates the cam 54 counterclockwise and causes the opposite wing 54*b* to engage the armature 46. This releases the engagement of the trip lever 42 by the armature 46, thereby separating the contacts 28 and 30.

The electro-magnetic blown-open separation of the primary contacts 28 and 30 occurs simultaneously with the separation of the secondary contacts 22 and 24 in the secondary section 14, to provide current-overload protection for levels in excess of about 3000 amperes. In response to the occurrence of a current fault above 3000 amperes, two additive forces develop in opposing directions between each set of contacts, the primary contacts 28 and 30 and the secondary contacts 22 and 24. The first force is the constriction resistance between each set of contacts. This provides a magnetic force that tries to separate the contacts. The second force results from the "U"-shaped current path configuration of the mid terminal 15 in combination with the associated contacts and the primary/secondary blade. This configuration forms a magnetic blowoff loop which creates an additional contact-separation force to separate each set of contacts substantially simultaneously.

Within the primary section 12, the primary blade 32 is biased by an extension spring 60 (FIG. 1), which is secured at one end to a retaining member 62 (FIGS. 5*a*, 5*b*) of the primary blade 32 and at the other end to a retaining member (not shown in FIG. 1) on the trip lever 42. The trip lever 42 is latched by the magnetic armature 46. The handle 44 is used to rotate the primary blade is to the contacts-closed position.

A high level short or fault causes the primary blade 32 to rotate counterclockwise until rotation is stopped by a blade stop 31 (molded as part of the base 10). During this rotation, the blade interface pivots 56*a* and 56*b* (FIGS. 3, 5*a*, 5*b*) remain in the fixed position and, at the same time the blade 32 is blowing open, the trip lever 42 is disengaged and rotating counterclockwise. The handle 44 and the blade interface pivots 56*a* and 56*b* move only after the trip lever 42 has moved sufficiently enough to take the blade 32 out of its toggle position, which occurs after the blade 32 returns to the contacts-closed position.

For further information concerning the primary blade 32, reference may be made to U.S. patent application Ser. No. 08/180,090, entitled "High Current Capacity Blade", filed Jan. 13, 1994, assigned to the instant assignee and incorporated herein by reference.

Within the secondary section 14, the collective separating force causes the secondary blade 20 to rotate counterclockwise about a pivot 49 to overcome the force of an extension spring 48 (FIG. 1), causing the extension spring 48 to stretch. The extension spring 48 permits the secondary blade 20 to continue to open as long as the force to open the blade is greater than the extension force of the spring 48. Thus, when the separating force decreases to a level which is less than the extension force of the spring 48, the spring 48 returns the secondary blade 20 to its normally-closed position.

Figure 5A:
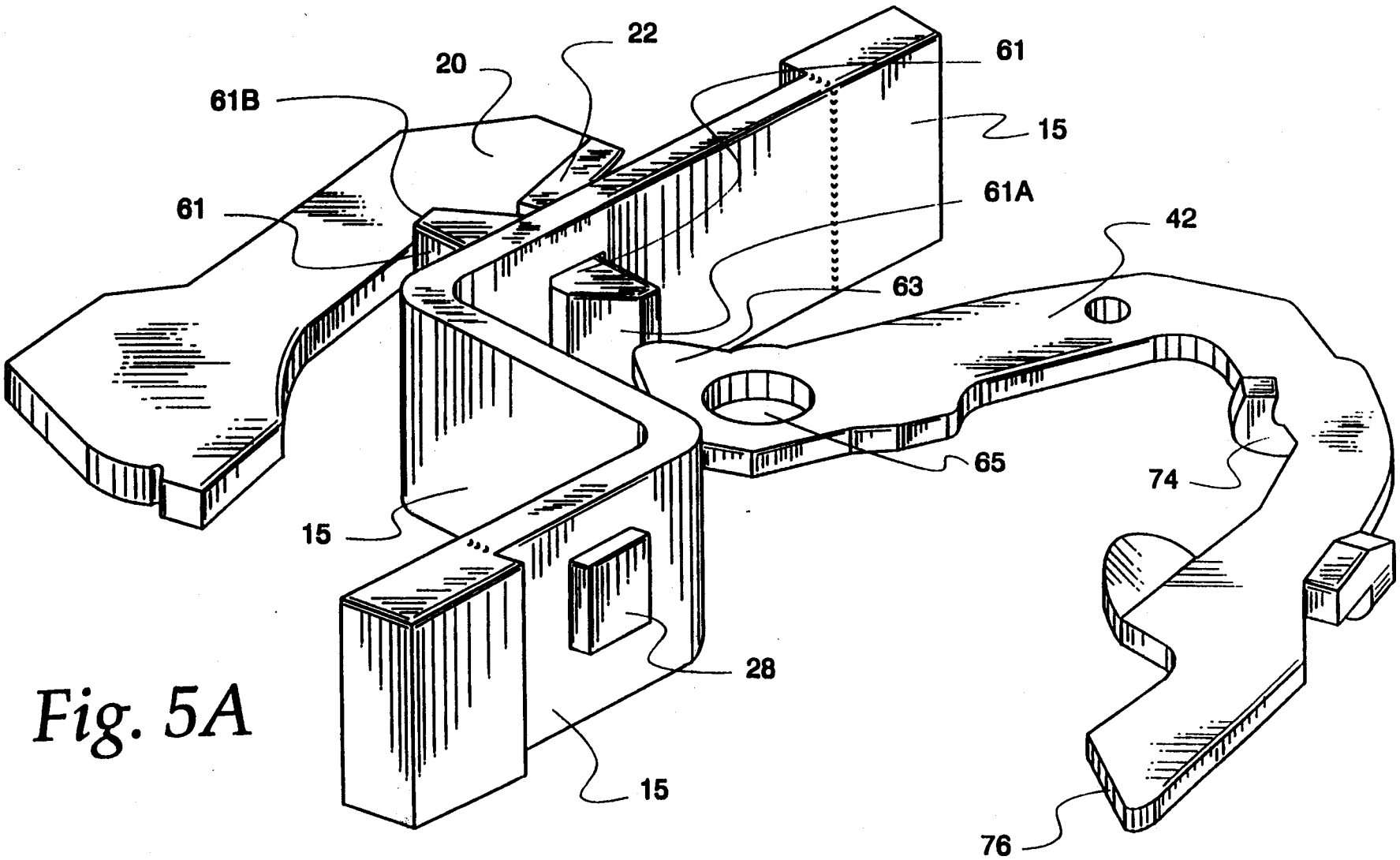
FIG. 5*a* is an illustration of a mid terminal and a kicker member, in accordance with the present invention, used in the circuit breaker of FIG. 1.

Other than the extension spring 48, the only other component acting upon the secondary blade 20 is a kicker 61, which slightly separates the contacts 28 and 30 in response to a "trip" (by trip lever 42) in order to prevent the over-current condition from welding the contacts 22 and 24 together. As best illustrated in FIG. 5*a*, the kicker 61 is an elongated plastic component residing in a hole through the center of the mid terminal 15, having one end 61*a* abutting a cam extension 63 on the trip lever 42, and another end 61*b* abutting the secondary blade 20 just below the secondary contact 22. Thus, in response to a tripped condition, the trip lever 42 rotates about a pivot 65 causing the cam extension 63 to engage the kicker 61 which, in turn, responds by striking the secondary blade 20 and maintaining it an insubstantial distance (about 0.025 inch) away from its normally-closed position. When the kicker 61 is not engaging the secondary blade 20, there is a distance between the end of the kicker 61 and the secondary blade of about 0.075 inch to ensure that the secondary contacts 22 and 24 are closed during normal operation.

The spring 48 and the blade 20 are therefore the only substantially active components in the secondary section, and this two-component arrangement requires no traditional current limiting components connected to the blade 20 to absorb arc-energy current resulting from a separation of the contacts 22 and 24. Rather, this current is minimized by the simultaneous separation of the contacts in the primary section. The arc energy developing between the contacts of the secondary section is absorbed by a secondary arc stack 66 (FIG. 1).

Figure 5B:
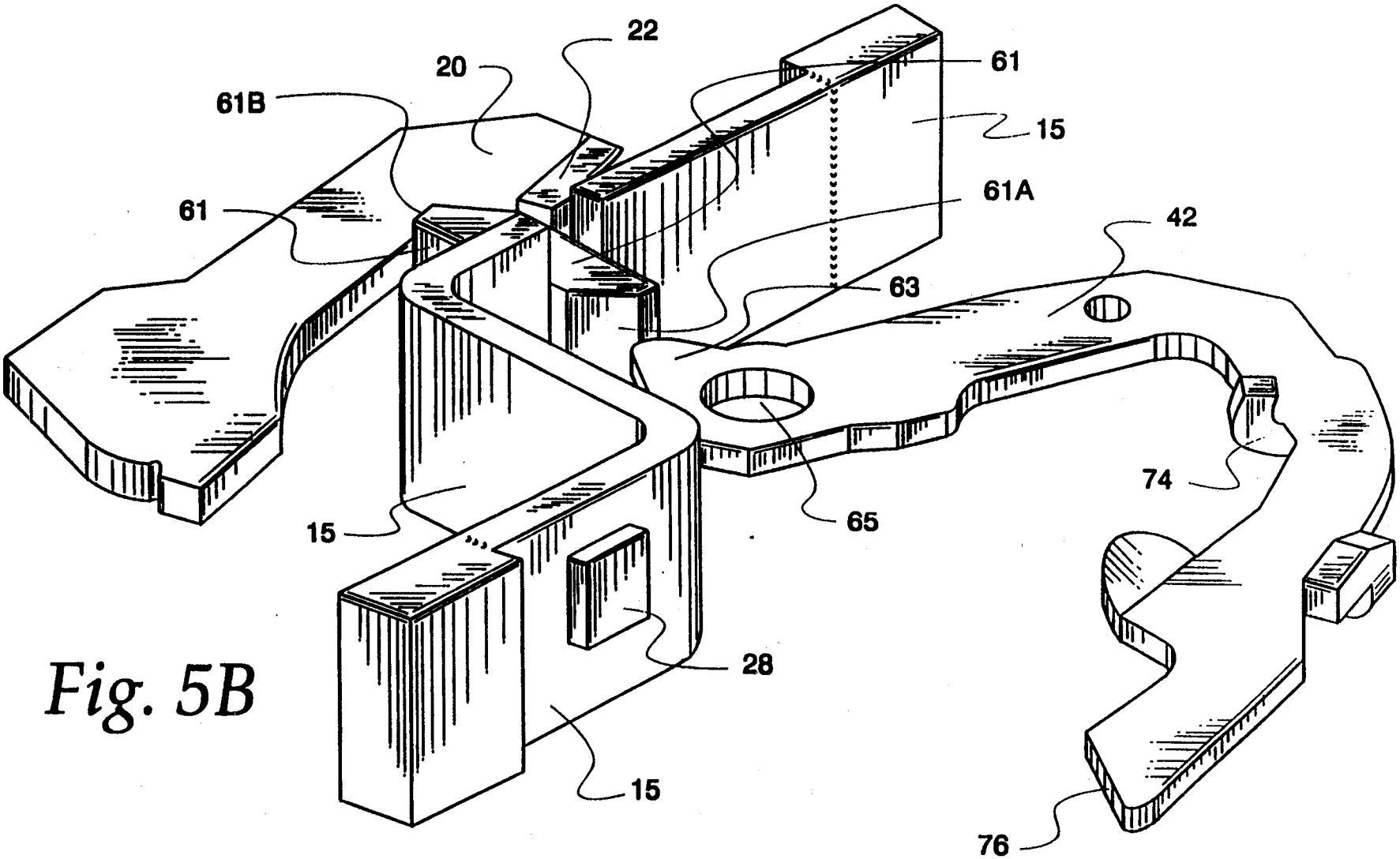
FIG. 5*b* is an illustration of an alternative mid terminal and kicker member arrangement, in accordance with the present invention, which can be used in place of the components shown in FIG. 5*a;*

FIG. 5*b* illustrates an alternative arrangement for the mid terminal 15 of FIGS. 1 and 5*a*. In this arrangement, a mid terminal 15' is identical to the mid terminal 15 except that the aperture therein, for receiving the kicker 61, is open all the way to the edge of the mid terminal 15'. This facilitates assembly because it is simpler to build using "Z"-axis automatic equipment. From an operational viewpoint, however, the arrangement of FIG. 5*a* is preferred because the mid terminal 15 isolates the primary section from the secondary section from sparks and debris.

Figure 6:
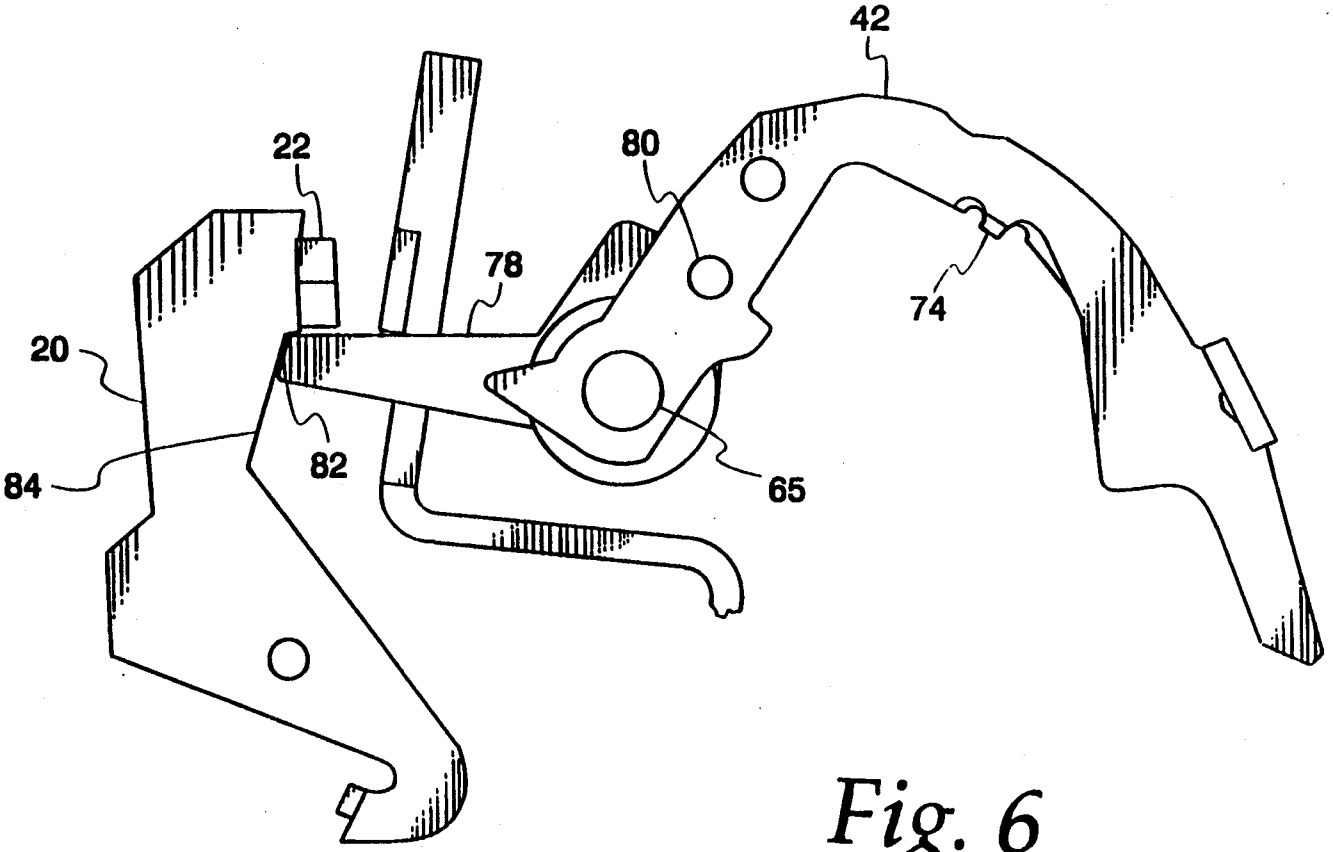
FIG. 6 is an expanded illustration of an alternative mid section which may be used in place of the structure shown in FIG. 1.

FIG. 6 illustrates yet another alternative for separating the contacts 22 and 24 as a reaction to a trip. The trip lever 42 is pivoted from trip lever pivot point 65 and is biased in the clockwise rotation by a primary toggle spring (not shown) which is attached to trip lever spring hook 74. The other end of the spring hook is attached to primary blade hook (62 of FIGS. *4a, 4b*). The trip lever 42 is held in its stationary position by the armature (46 of FIG. 3). When the trip lever is disengaged from the armature, the trip lever 42 is rotated in the clockwise motion, causing a rotary kicker 78 (secured thereto) to rotate in the same direction and strike the secondary blade 20 to separate the contacts 22 and 24.

More specifically, the rotary kicker 78 is secured via a male engagement point 80 which positions into a mating hole on the trip lever. The rotary kicker 66 has an extending arm surface 82 which engages a smooth cam surface 84 on the secondary blade 20. When a fault occurs, trip lever 42 is released and starts to rotate in a clockwise direction. The spring force at hook 74 takes over and continues to rotate the trip lever in the clockwise position. The rotary kicker's extension point 82 engages the secondary blade's cam surface 84 and starts to rotate the secondary blade 20 in a counterclockwise rotation. As with the other aspects of the circuit breaker of FIG. 1, this rotary kicker arrangement is also "Z"-axis assembled.

Within the primary section 12, the arc voltage that is generated as the primary contacts 28 and 30 are separated is guided out of the circuit breaker by an arc-transfer blade 67, a primary arc stack 68 and an arc-reflecting slide-fiber element 69. The blade 67 is positioned close enough to the sweeping radius of the contact 30 so that it can accommodate lower level fault currents in the circuit breaker, which is important because the secondary blade does not operate in response to lower-level faults. As the contact 30 passes next to the closest part of the arc-transfer blade 67, the arc jumps to the surface of the blade 87, which provides the arc with a linear path through the arc stack and prevents the arc from trying to reignite between the contacts 28 and 32. Thus, the arc energy is guided out to the load terminal 38 along the arc-transfer blade 67. At higher energy levels, the arc-transfer blade 67 reduces the stress on the bimetal member 36 by diverting the current therefrom and onto the arc-transfer blade 67. The slide fiber 69 produces gaseous ions which help to drive the arc energy into the are stack 68.

Because both sets of contacts separate simultaneously, the combination of the arc voltages within the secondary are stack 66 and the primary arc stack 68 results in these arc voltages being additive. This provides a very fast rise of are voltage and also allows high levels of are voltage to generated within the disclosed circuit breaker, as required in many applications in need of double break circuit breakers.

For further information concerning the primary and secondary arc stacks 66 and 68 and the manner in which are energy is shunted from between the contacts, reference may be made to U.S. patent application Ser. Nos. 08/181,288 and 08/181,290, respectively entitled "Arc Stack for a Circuit Breaker" and "Blade Transfer Arc Shunt", filed concurrently herewith, assigned to the instant assignee and also incorporated herein by reference.

Calibration of the thermal tripping characteristics is performed by adjusting a calibration screw 72 (FIG. 1) to set the proper position for the bimetal member 36. The load terminal 38 is connected to the bimetal member 36 so that when the calibration screw 72 is turned in a clockwise direction, the calibration screw 72 pulls the middle of the load terminal 38 towards the head of the calibration screw 72. Thus, both the yoke 50 and the armature 46 can be moved toward or away from the load terminal 38 for the appropriate setting. For further information regarding the this calibration process as well as further details on the load terminal 38, the bimetal member 36 and the depressible member 51, reference may be made to U.S. patent application Ser. No. 08/181,287, entitled "Circuit Breaker Having Double Break Mechanism", filed concurrently herewith, assigned to the instant assignee and incorporated herein by reference.

Figure 7:
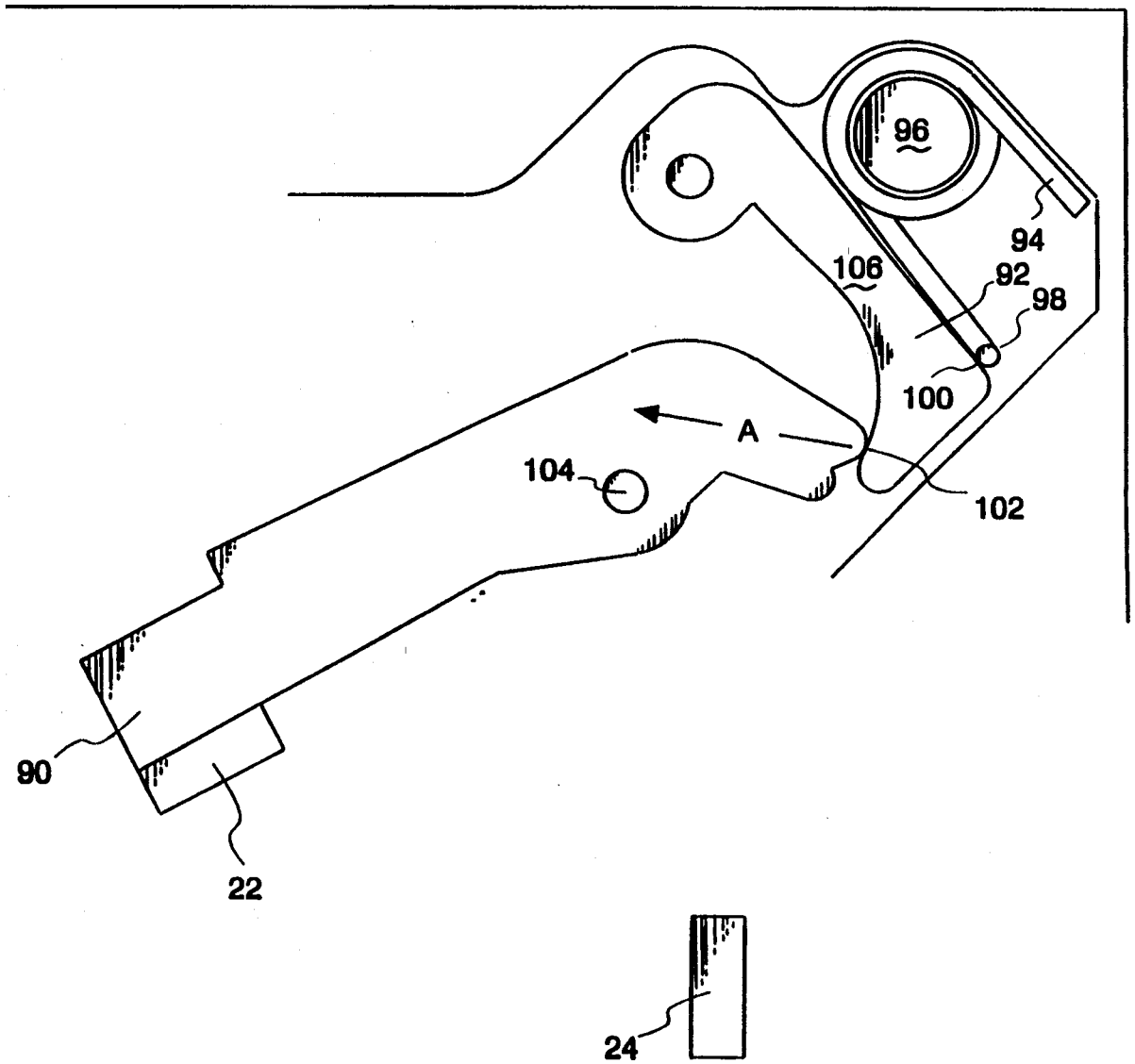
FIG. 7 is an illustration of an alternative circuit breaker, according to the present invention, using a component arrangement similar to the one shown in FIG. 1 but using a cam/torsion-spring arrangement in the secondary section.

FIG. 7 illustrates an alternative way to implement the biasing force on the blade 20 in the secondary section 14 of the circuit breaker of FIG. 1. The secondary blade 90 of FIG. 7 is very similar to the secondary blade 20 of FIG. 1 but the secondary blade 90 uses a blade cam 92 and a torsion spring 94 instead of the extension spring 48 of FIG. 1.

The torsion spring 94 generates a torque about a spring pivot 96. This torque is seen at spring end 98, which interfaces with the cam 92 at a touch point 100. This torque exerts a force in a direction to rotate the cam 92 about the cam pivot. At an interface point 102, the cam 92 engages the secondary blade at its end. The force provided to the secondary blade 90 transmits a force in the direction of arrow A shown in FIG. 7. This force results in a torque on the secondary blade 90 to try to rotate it toward the contact 24 about the secondary blade pivot 104. If this blade was in the up position as shown with no current applied, the blade would rotate counterclockwise until it would close the movable and stationary contact. As the blade 90 rotates in this manner, the end of the secondary blade rides along the cam surface starting at point 102 and finishing at interface point 106. At interface point 106, the contacts 22 and 24 are closed and the contact pressure in terms of the force at the contacts is at its working value. In the reverse mode when the blade is blown open by a high fault current, the interface point starts at point 106 and finishes at point 102. When the blade rotates in this direction, the torque on the secondary blade 90 will start to decrease as the blade opens to its full open position. This is a distinct advantage over other suspensions.

Another advantage to this design is the small area that is required for the torsion spring 94 that generates the energy for the contact force. If an extension spring was attempted in this particular design, the packaging would require more space due to the length of the extension spring. This arrangement requires less force on the secondary blade as it rotates into the open position, and can be implemented using "Z"-axis assembly.

Accordingly, a double break circuit breaker has been disclosed, embodying the principles of the present invention, which provides high-end performance in terms of interruption with independent operation of primary and secondary blades for a simple design and better resistance stability when used in switching tests. The overall impact is lower product cost at higher performance than any previous circuit breaker design.

Those skilled in the art will readily recognize that various modifications and changes may be made to the present invention without departing from the true spirit and scope thereof, which is set forth in the following claims.

What is claimed is:

1. A circuit breaker for passing current during a normal condition and, in response to at least one abnormal condition, for interrupting the current, comprising:

a pair of primary contact assemblies, each of the primary contact assemblies including a respective contact, at least one of the primary contact assemblies being constructed and arranged to interrupt the current by moving from a normally closed position to an open position;

an engagement member providing an engagement force in response to the movement of the one of the primary contact assemblies from the normally closed position;

a spring; and a pair of secondary contact assemblies, each of the secondary contact assemblies including a respective contact, one of the secondary contact assemblies being stationary and the other of the secondary contact assemblies having a movable contact arm coupled to the engagement member and rotatable about a pivot and biased by the spring toward a normally closed position such that; in response to the over-current condition exceeding a predetermined level, the movable contact arm rotates away from the normally closed position until the over-current condition falls below the predetermined level at which time the movable contact arm rotates toward the normally closed position, and, in response to the engagement force provided by the engagement member, the movable contact arm of said other of the secondary contact assemblies rotates away from the normally closed position.

2. A circuit breaker, according to claim 1, wherein the spring is an extension spring.

3. A circuit breaker, according to claim 2, wherein the extension spring has one end secured to the movable contact arm.

4. A circuit breaker, according to claim 1, further including a conductive plate having a first portion constructed and arranged as part of the first pair of contact assemblies and having a second portion being constructed and arranged as part of said one stationary secondary contact assembly.

5. A circuit breaker, according to claim 1, wherein the movable contact arm is constructed and arranged to interrupt the current by rotating away from the normally closed position in response to a blow-open force.

6. A circuit breaker, according to claim 5, wherein the movable contact arm rotates a substantial distance away from the normally closed position.

7. A circuit breaker, according to claim 5, wherein the movable contact arm rotates a substantial distance away from the normally closed position solely in response to the blow-open force.

8. A circuit breaker, according to claim 7, said at least one of the primary contact assemblies and said movable contact arm of the secondary contact assemblies interrupting the current in response to the blow-open force by moving substantially simultaneously.

9. A circuit breaker, according to claim 1, wherein the spring is arranged in a first plane and the movable contact arm is arranged in a second plane which is different from the first plane.

10. A circuit breaker, according to claim 1, wherein the pair of primary contact assemblies and the pair of secondary contact assemblies are respectively located in first and second sections, said first and second sections constructed and arranged to substantially isolate the pair of primary contact assemblies from the pair of secondary contact assemblies.

11. A circuit breaker for passing current during a normal condition and, in response to at least one abnormal condition, for interrupting the current, comprising:

a pair of primary contact assemblies, each of the primary contact assemblies including a respective contact, at least one of the primary contact assemblies being constructed and arranged to interrupt the current by moving from a normally closed position to a latched open position;

a spring;

a pair of secondary contact assemblies, each of the secondary contact assemblies being including a respective contact, at least one of the secondary contact assemblies being biased by the spring toward a normally closed position and being rotatable about a pivot away from the normally closed position against the bias of the spring; and an engagement member coupled to said at lease one of the primary contact assemblies and to said at least one of the secondary contact assemblies, the engagement member causing said at least one of the secondary contact assemblies to rotate about the pivot in response to said at least one of the primary contact assemblies moving from the normally closed position.

12. A circuit breaker, according to claim 11, wherein the spring is an extension spring.

13. A circuit breaker, according to claim 11, wherein said at least one of the primary contact assemblies moves from the normally closed position to a blown-open position in response to a first abnormal current condition and to a tripped position in response to a second abnormal current condition.

14. A circuit breaker, according to claim 13, further including a latch for latching said at least one of the primary contact assemblies in the tripped position.

15. A circuit breaker, according to claim 13, wherein the engagement member causes said at least one of the secondary contact assemblies to rotate about the pivot an insubstantial distance.

16. A circuit breaker, according to claim 15, wherein said at least one of the secondary contact assemblies rotates about the pivot a substantial distance in response to the first abnormal current condition.

17. A circuit breaker, according to claim 16, wherein said at least one of the primary contact assemblies moves from the normally closed position and said at least one of the secondary contact assemblies rotates about the pivot substantially simultaneously in response to the first abnormal condition.

18. A circuit breaker, according to claim 13, wherein said at least one of the primary contact assemblies moves from the normally closed position and said at least one of the secondary contact assemblies rotates about the pivot substantially simultaneously in response to the first abnormal condition.

19. A circuit breaker, according to claim 11, further including a first arc absorption element adjacent the pair of primary contact assemblies and a second arc absorption element adjacent the pair of secondary contact assemblies.

20. A circuit breaker, according to claim 11, wherein the pair of primary contact assemblies and the pair of secondary contact assemblies are respectively located in first and second sections, said first and second sections constructed and arranged to substantially isolate the pair of primary contact assemblies from the pair of secondary contact assemblies.

21. A circuit breaker, according to claim 12, further including a conductive plate having a first portion constructed and arranged as part of the pair of primary contact assemblies and having a second portion constructed and arranged as part of said pair of secondary contact assemblies.

22. A circuit breaker, according to claim 21, wherein the engagement member traverses the conductive plate.

23. A circuit breaker for passing current during a normal condition and, in response to at least one abnormal condition, for interrupting the current, comprising:

a pair of primary contact assemblies, one of the primary contact assemblies including a respective contact, one of the primary contact assemblies being constructed and arranged to interrupt the current by rotating away from a normally closed position to at least one open position in response to a first abnormal current condition;

a pair of secondary contact assemblies, each of the secondary contact assemblies including a respective contact, one of the secondary contact assemblies being constructed and arranged to interrupt the current by rotating from a normally closed position:

in response to said one of the primary contact assemblies rotating in response to the first abnormal current condition, and in response to a second abnormal current condition which is different from said first abnormal condition.

24. A circuit breaker, according to claim 23, further including a spring biasing said at least one of the secondary contact assemblies toward the normally closed position.

25. A circuit breaker, according to claim 23, further including an engagement member coupled to said at least one of the primary contact assemblies and to said at least one of the secondary contact assemblies, the engagement member causing said at least one of the secondary contact assemblies to rotate in response to said at least one of the primary contact assemblies rotating.

26. A circuit breaker, according to claim 23, further including a spring biasing said at least one of the secondary contact assemblies toward the normally closed position.

27. A circuit breaker, according to claim 23, further including a cam member engaging and biasing said at least one of the secondary contact assemblies toward the normally closed position.

28. A circuit breaker, according to claim 27, further including a spring coupled to the cam member so as to provide the bias to said at least one of the secondary contact assemblies toward the normally closed position.

29. A circuit breaker, according to claim 28, wherein the spring is a torsion spring.

30. A circuit breaker for passing current during a normal condition and, in response to at least one abnormal condition, for interrupting the current, comprising:

a pair of primary contact assemblies, each of the primary contact assemblies including a respective contact, one of the primary contact assemblies being constructed and arranged to interrupt the current by rotating away from a normally closed position to at least one open position in response to a first abnormal current condition;

a pair of secondary contact assemblies, each of the secondary contact assemblies including a respective contact, one of the secondary contact assemblies being constructed and arranged to interrupt the current by rotating from a normally closed position;

a cam member engaging and biasing said at least one of the secondary contact assemblies toward the normally closed position;

a torsion spring coupled to the cam member so as to provide the bias to said at least one of the secondary contact assemblies toward the normally closed position.

31. For use in a circuit breaker, a method for passing current during a normal condition and, in response to at least one abnormal condition, for interrupting the current, the method comprising the steps of:

using a pair of primary contact assemblies to interrupt the current in response to a first abnormal current condition, each of the primary contact assemblies including a respective contact;

using a pair of secondary contact assemblies to interrupt the current as a reaction to the pair of primary contact assemblies interrupting the current in response to the first abnormal current condition, each of the secondary contact assemblies including a respective contact;

responsive to the primary contact assemblies, causing the pair of secondary contact assemblies to separate;

using the pair of primary contact assemblies and the pair of secondary contact assemblies to interrupt the current substantially simultaneously in response to a second abnormal current condition.

* * * * *